US005431388A

United States Patent [19]

Bridoux

[11] Patent Number: 5,431,388

[45] Date of Patent: Jul. 11, 1995

[54] DEVICE FOR THE TRANSFER OF SETS OF SHEETS COMING FROM A PRINTING OR COPYING MACHINE TO A FINISHING MACHINE

[75] Inventor: Patrick Bridoux, Marbais, Belgium

[73] Assignee: C. P. Bourg, S.A., Ottignies-Louvain L.N., Belgium

[21] Appl. No.: 252,312

[22] Filed: Jun. 1, 1994

[30] Foreign Application Priority Data

Jun. 2, 1993 [FR] France ..... 93 06582

[51] Int. Cl.[6] ..... B65H 9/16

[52] U.S. Cl. ..... 271/252; 271/272; 271/277

[58] Field of Search ..... 271/248, 250, 252, 272, 271/273, 274, 275, 277

[56] References Cited

U.S. PATENT DOCUMENTS

| | | | |
|---|---|---|---|
| 1,618,625 | 2/1927 | Kyle | 271/40 |
| 2,302,067 | 11/1942 | Spiess | 271/272 X |
| 3,536,322 | 10/1970 | Shimizu | 271/250 |
| 3,995,847 | 12/1976 | Schiff | 270/58 |
| 4,227,685 | 10/1980 | Fischer | 271/252 X |
| 5,080,348 | 1/1992 | Pendell et al. | 271/289 |
| 5,085,623 | 2/1992 | Mitchard | 271/250 X |
| 5,149,081 | 9/1992 | Greive | 271/272 |
| 5,280,903 | 1/1994 | Herrick, Jr. | 271/248 X |

FOREIGN PATENT DOCUMENTS

| | | | |
|---|---|---|---|
| 2582115 | 11/1986 | France | 271/273 |
| 1060170 | 6/1959 | Germany | 271/272 |
| 1173915 | 7/1964 | Germany | 271/272 |
| 2452050 | 5/1976 | Germany | 271/250 |

OTHER PUBLICATIONS

Xerox Disclosure Journal, vol. 3, No. 6, 1 Nov. 1978, pp. 413–414, Buddendeck, Automatic Side Registration for Finisher.

*Primary Examiner*—David H. Bollinger
*Assistant Examiner*—Carol L. Druzbick
*Attorney, Agent, or Firm*—Sixbey, Friedman, Leedom & Ferguson; Gerald J. Ferguson, Jr.; Donald R. Studebaker

[57] ABSTRACT

In order to make it unnecessary to shift a finishing machine (12) out of a position adjacent to a printing or copying machine (10) the invention provides a transfer device for sets of sheets leaving the printing or copying machine (10) for the set finishing machine (12). The printing or copying machine (10) comprises a door (14) with an ejection opening for the sets and the said finishing machine (12) possesses an inlet side opposite such opening, such door (14) opening toward the inlet side of the finishing machine (12). The device comprises a conveyor (16) articulated in a frame (18) integral with the finishing machine (12) around a horizontal axis (A) and having a length such that its free end follows a course of movement, during a pivotal movement of the conveyor (16) out of a lower position adjacent to the ejection opening of the printing or copying machine (10) into a raised position, which is not obstructed by the printing or copying machine, such door (14), in the raised position of the conveyor (16), being able to be freely opened without displacement of the finishing machine (12).

15 Claims, 11 Drawing Sheets

DEVICE FOR THE TRANSFER OF SETS OF SHEETS COMING FROM A PRINTING OR COPYING MACHINE TO A FINISHING MACHINE

The invention relates to a device for the transfer of sets of sheets coming from a printing or copying machine to a finishing machine and more particularly for a printing or copying machine having a door with an ejection opening for such sets of sheets and furthermore a finishing machine having an intake side which is opposite to such opening, said door opening towards the intake side of the finishing machine.

It is a conventional practice to associate a machine such as a printing or copying machine with a train of accessory units such as a stapling machine, a folder, a cutting machine, a gluing machine or a stacking table. Such accessories, which may in more general terms be named finishing machines for sets of sheets, are loaded with sets of sheets, or in the single sheet mode, with one sheet after another, which come off the printing or copying machine through an ejection opening. The finishing machine, or the first accessory machine in the case of there being a train of such machines, is generally directly adjacent to the printing or copying machine in order to permit a direct transfer of the sets of ejected sheets coming from the printing or copying machine to a finishing machine. In certain cases the ejection opening for the sheet sets is provided in a door of the printing or copying machine, such door, when opened, permitting access to the machine for servicing it or for replacing materials it uses. In order to open such door it is consequently necessary to move back the finishing machine, or if present, the complete train of accessory units. When the operation has been terminated, the door is shut again and the finishing machine may then be moved back into its position adjacent to the printing or copying machine. Although the various accessory units are mounted on casters, changing the position thereof is nevertheless difficult and, moreover something needing special attention, seeing that they are heavy and that it is necessary to reposition them exactly in relation to the printing or copying machine. Since modern machines operate at high rates, there is frequently a need to perform servicing or refilling operations. Despite such obvious disadvantages no remedy has so far been suggested in the art.

The present invention provides a solution to such problem by the provision of a sheet set transfer device which is characterized in that it comprises a conveyor articulated in a frame integral with the finishing machine for pivoting around a horizontal axis and having a length such that a free end thereof follows a course of movement, during a pivotal movement of the conveyor out of a lower position adjacent to the ejection opening of the printing or copying machine into a raised position, which is not obstructed by the printing or copying machine, such door, in the raised position of the conveyor, being able to be freely opened without displacement of the finishing machine. The conveyor consequently constitutes a sort of mobile bridge between the two machines, such machines not being directly adjacent, but rather spaced apart sufficiently to allow opening of the door when the conveyor is in its raised position. The finishing machine, or the train of accessaries units, may consequently remain in position and do not have to be shifted.

Preferably the conveyor is arranged in a floating manner so that no modification is necessary to adapt to the level of the printing or copying machine. For the same purpose the lower position of the conveyor is preferably defined by abutment means operated by the finishing machine. If necessary locking means will be provided in order to lock the conveyor in the lower position thereof.

In order to facilitate the pivotal movement of the conveyor such movement is preferably assisted by a preferably pneumatic piston and cylinder unit. Such piston and cylinder unit may simultaneously constitute an abutment for the lower position of the conveyor.

Further advantageous developments and details of the invention will be understood from the following disclosure in conjunction with the accompanying drawings.

Figure 11:
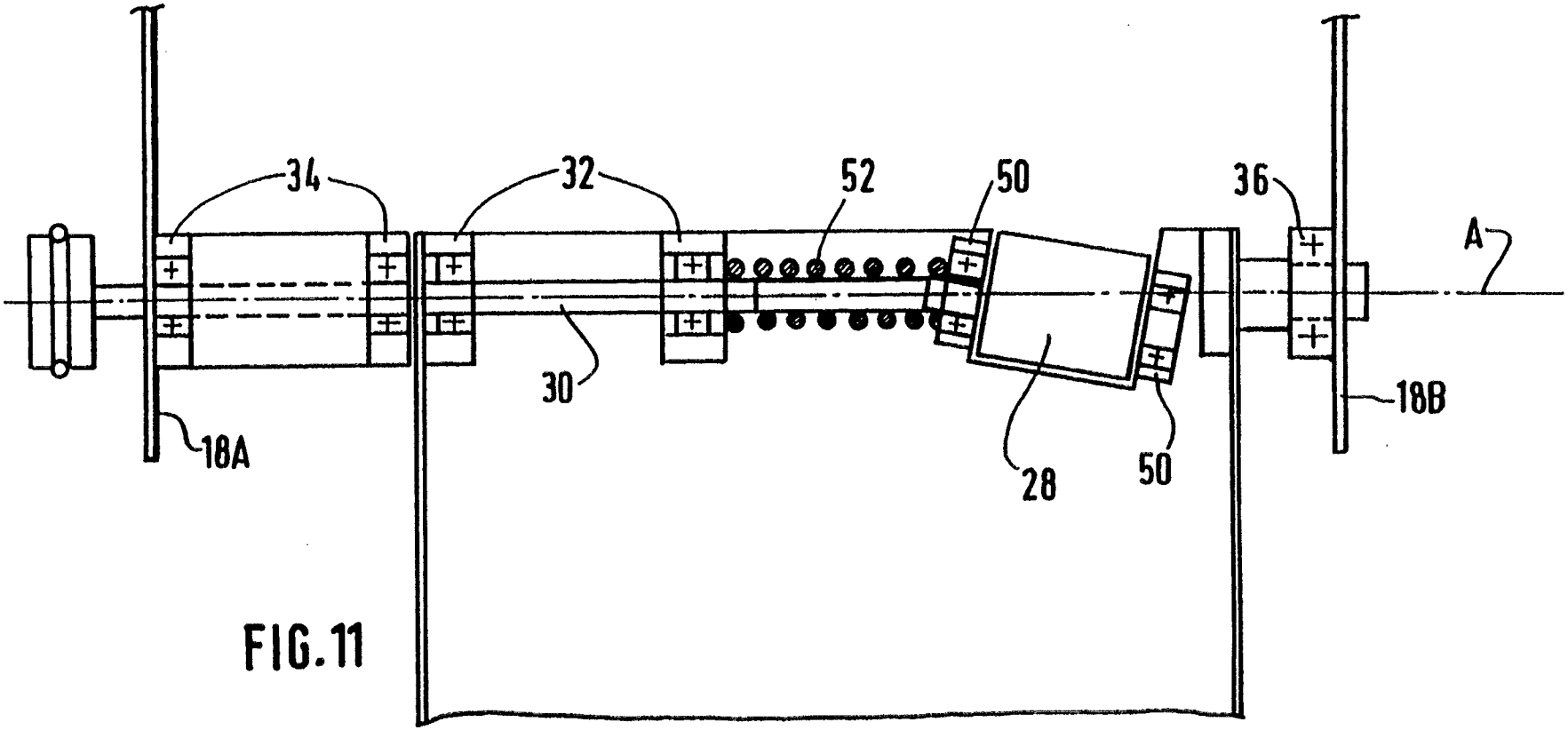

FIG. 11 diagrammatically shows the articulated end of the conveyor and its driving shaft.

Figure 12:
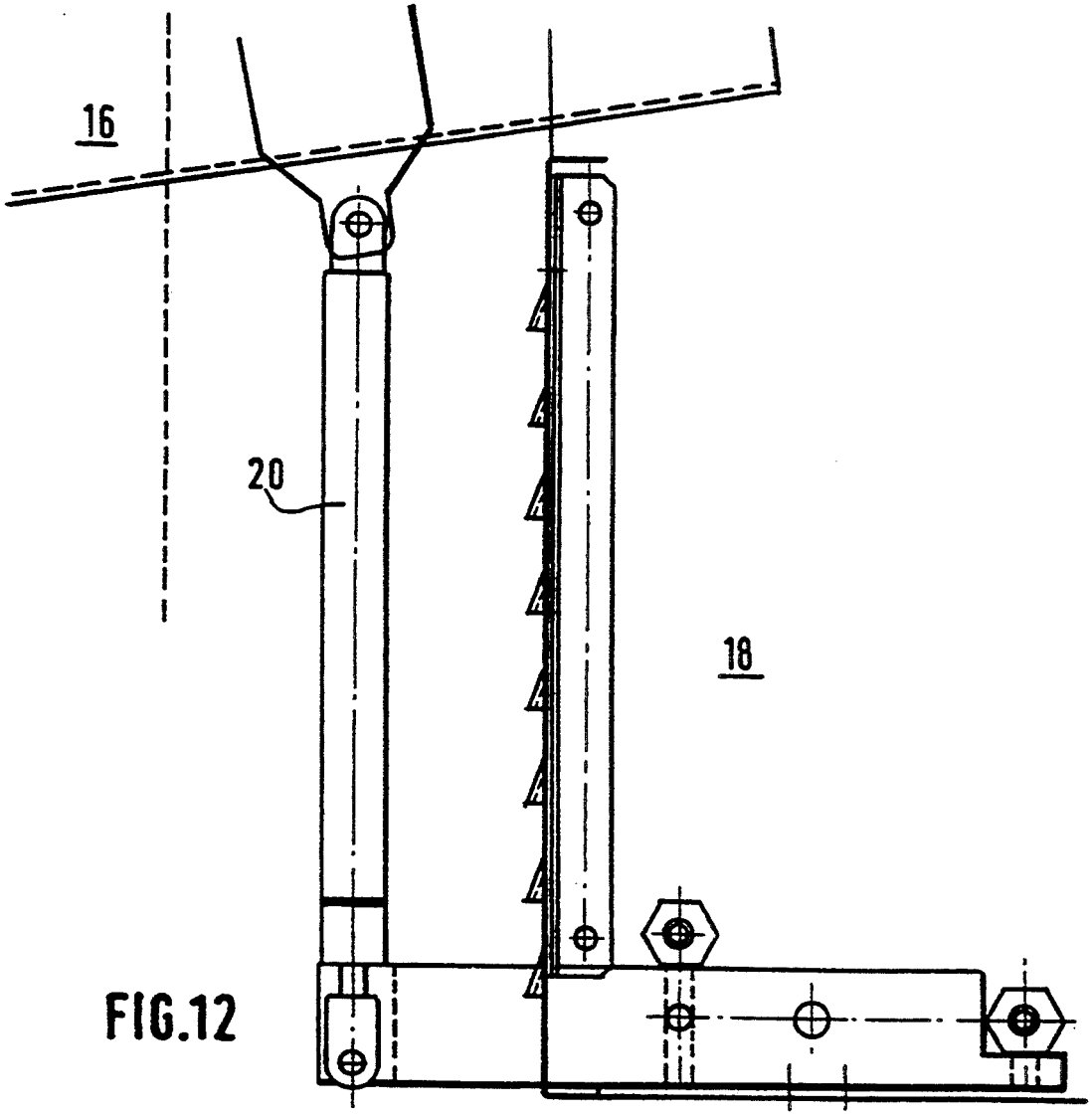

FIG. 12 shows an abutment system of the conveyor.

Figure 1:
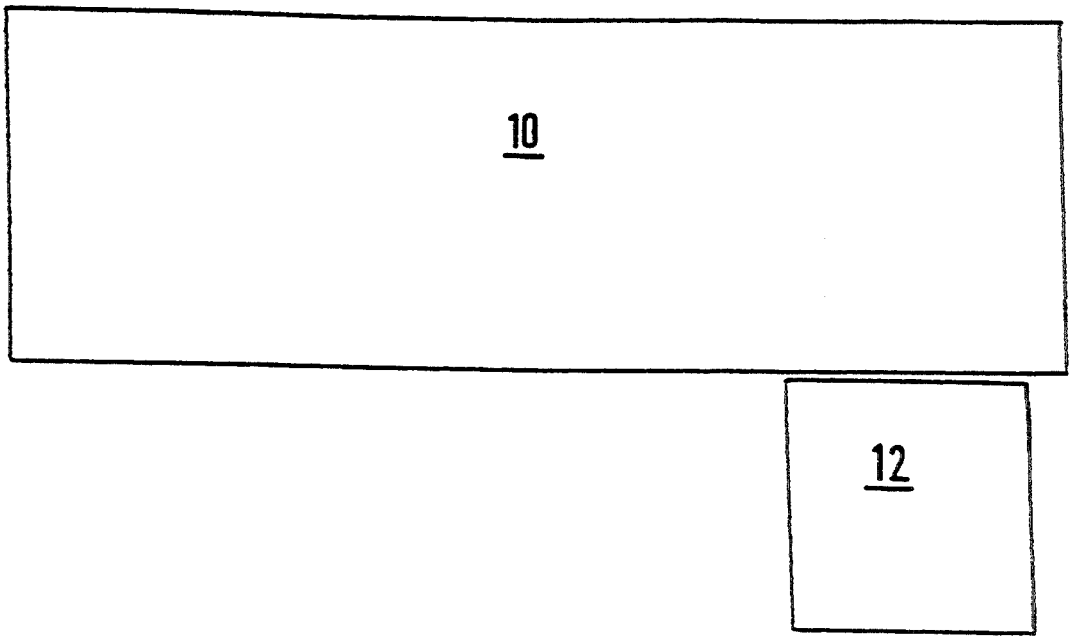
FIGS. 1 and 2 are highly diagrammatic plan views of two machines arranged in accordance with the prior art.
Figure 2:
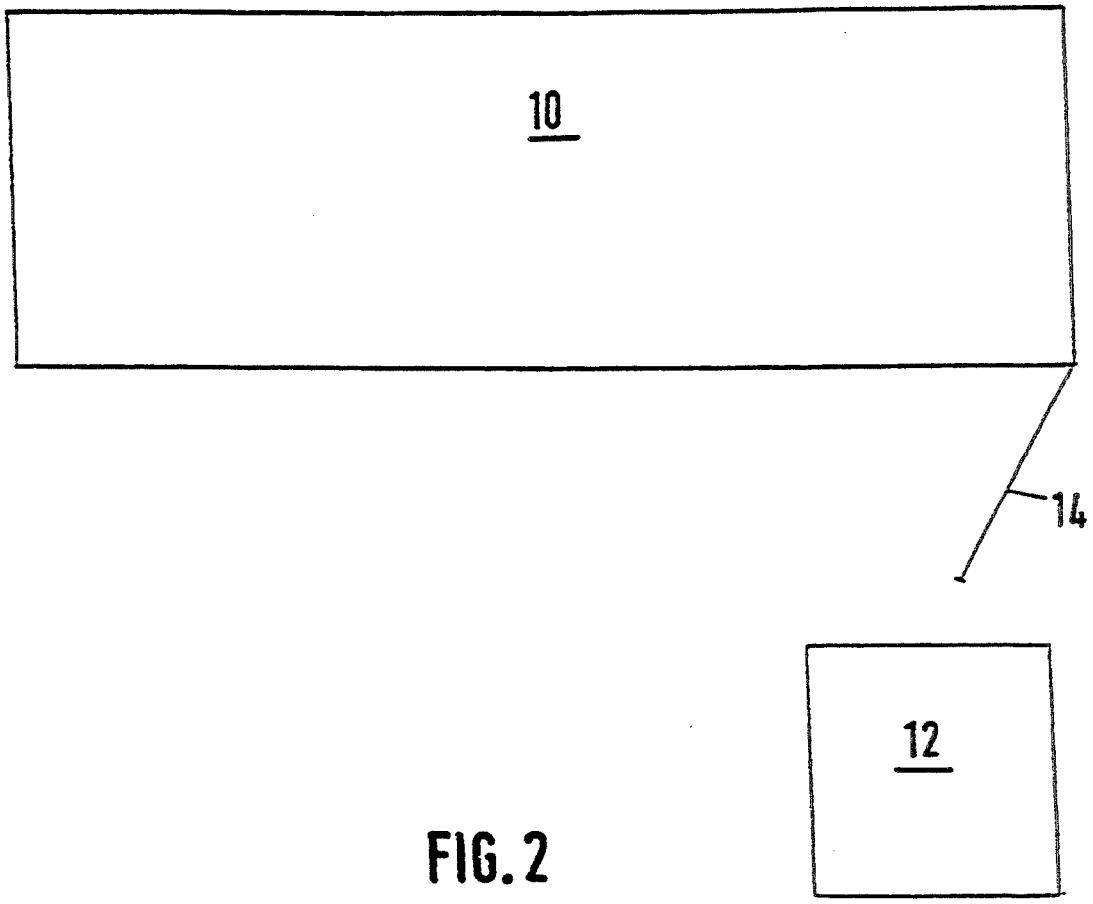

In FIGS. 1 and 2 the reader will see a printing or copying machine 10 and a finishing machine 12 positioned adjacent to the machine 10. In order to simplify the following account the finishing machine is only in the form of a single unit, as for instance a stapling machine. However it is current practice to associate a train of accessory units with the machine 10, such as a stapling machine, a folder, a cutting machine which may constitute an integral block.

The machine 10 has a door 14 hinged for pivoting around a vertical axis as illustrated in FIG. 2. Such door 14 is provided with an ejection opening for the sets of sheets produced in the machine 10. The machine 12 is consequently opposite to the door at its intake side in order to permit the direct transfer of the sets of sheets emerging from the opening of the door towards the machine 12. The door 14 gives access to the interior of machine 10 for servicing it in case of need or to restock it with materials. Prior to being able to open the door 14, the machine 12 must be pulled back as is illustrated in FIG. 2.

Figure 3:
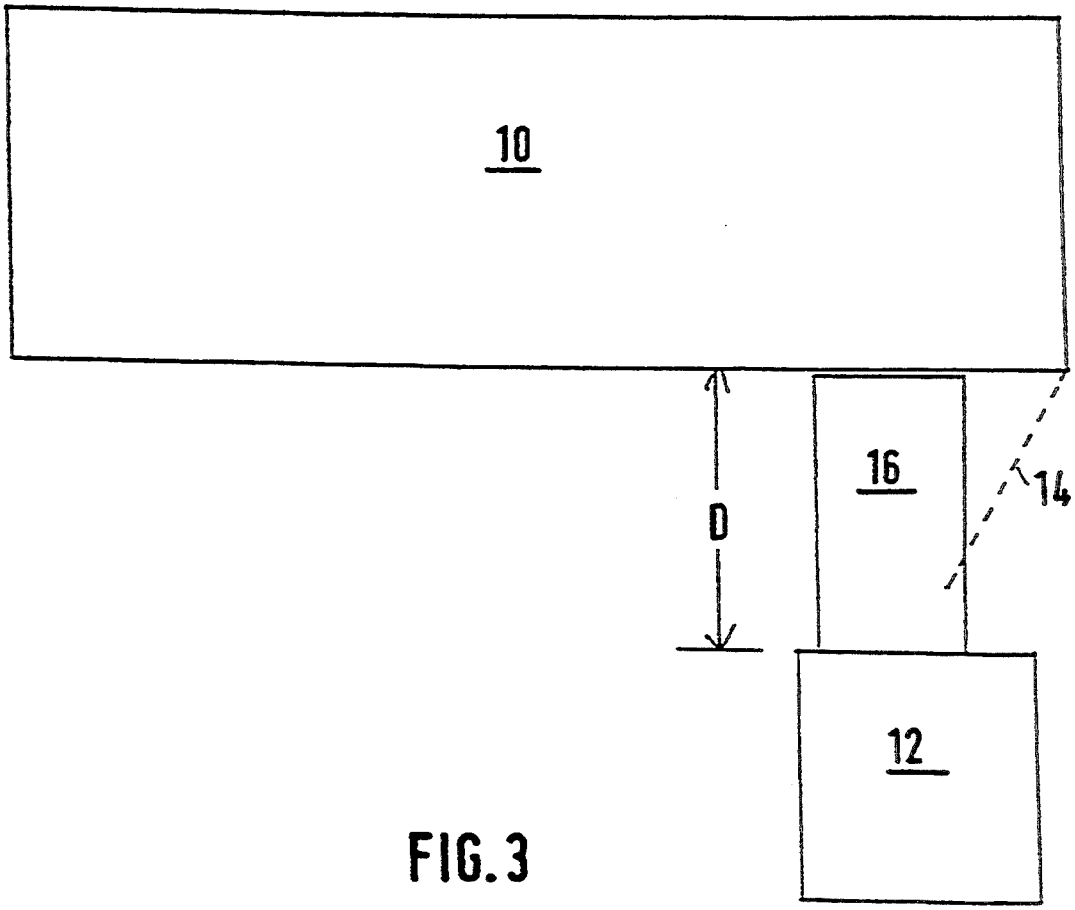
FIG. 3 is a diagrammatic plan view of the same machine arranged in accordance with the invention.

In accordance with the invention as depicted in FIG. 3, the machine 12 is arranged in a stationary or fixed fashion at a distance D in front of the door 14 of the machine 10. This distance D suffices to permit free opening of the door 14. The machines 10 and 12 are connected by a transfer means which comprises a moving conveyor 16.

Figure 4:
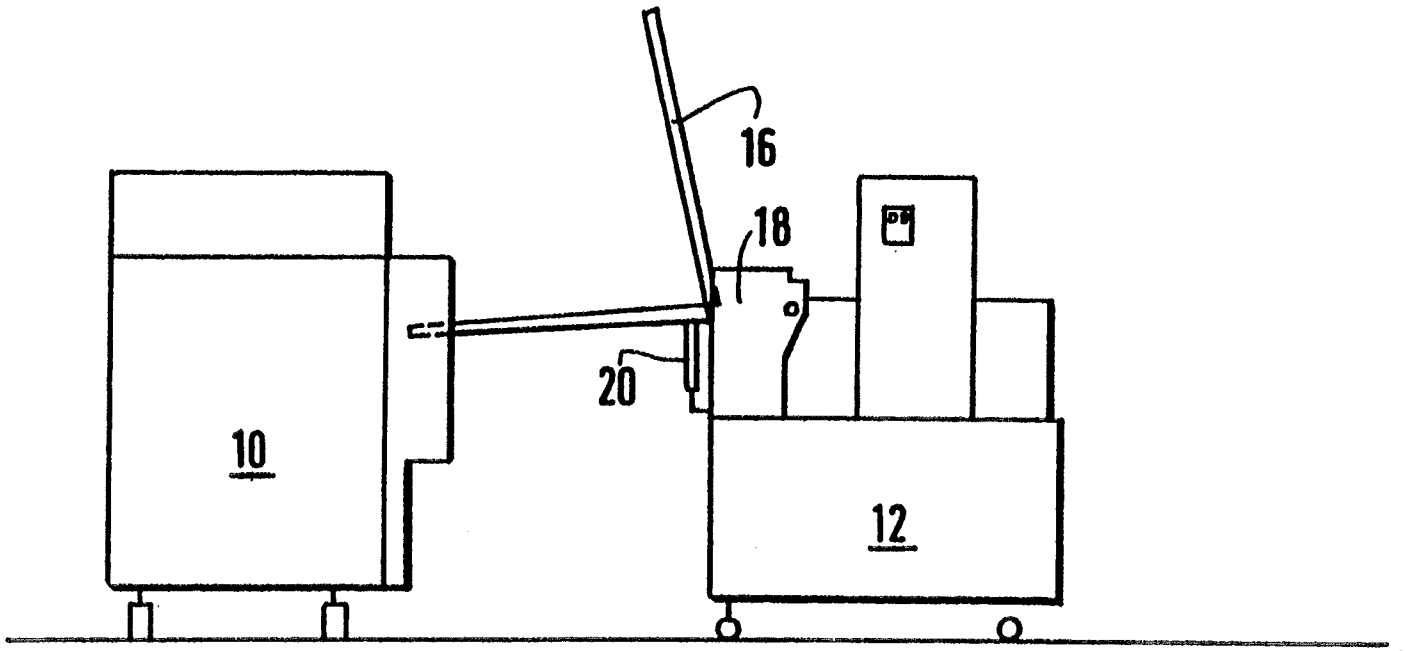
FIG. 4 is a diagrammatic elevation showing the two machines spaced apart and with a pivotal conveyor constituting a moving bridge between the machines.
Figure 5:
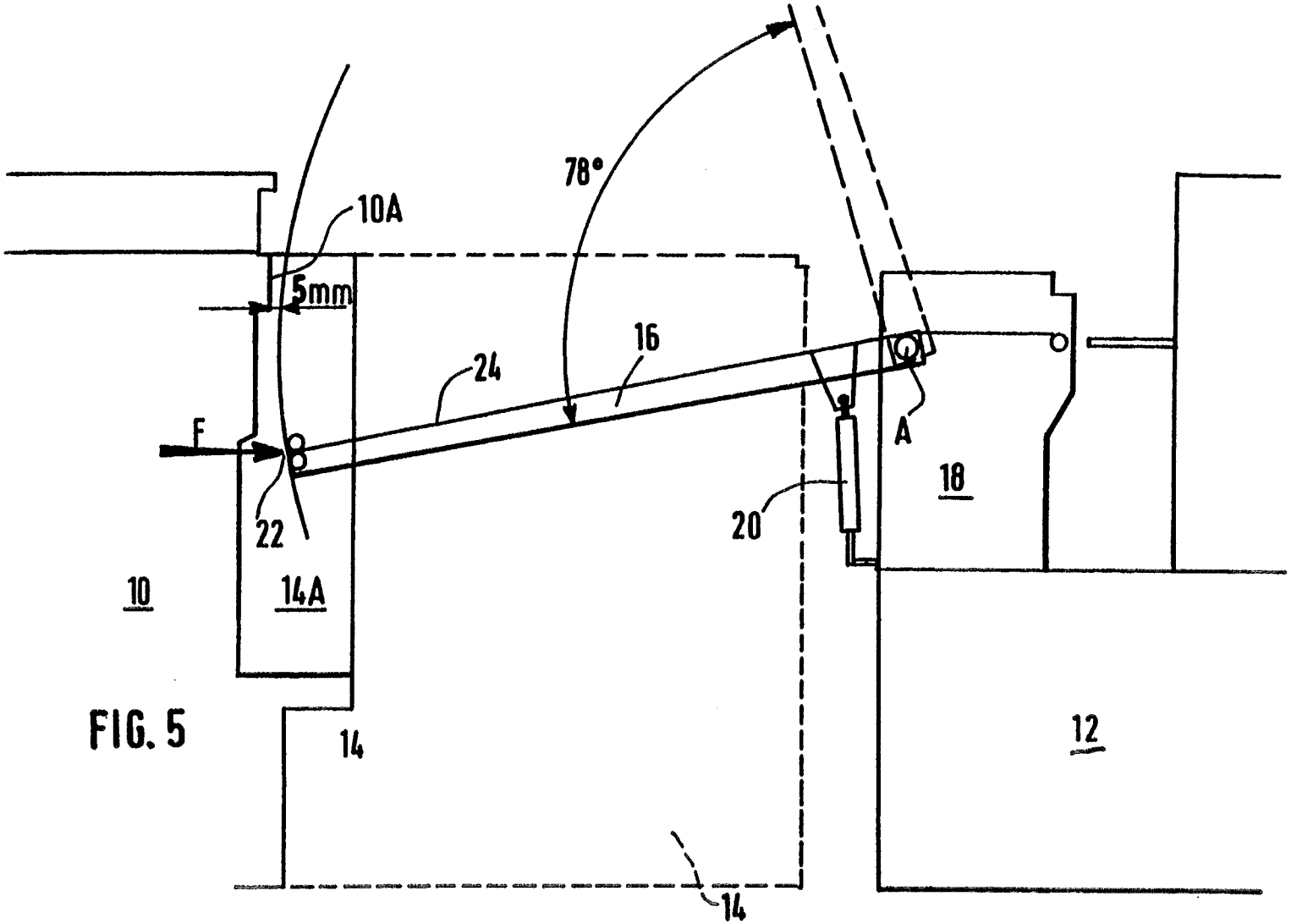
FIG. 5 is a view of part of the arrangement corresponding to FIG. 4, but on a greater scale.

As will be seen from the FIGS. 4 and 5, this conveyor 16 is mounted in a pivotal, cantilever fashion in a frame 18 of the machine 12. The pivotal movement of the conveyor 16 is aided by one or more pneumatic piston and cylinder units 20. The piston rod of the unit 20 is connected with the frame 18, the cylinder being connected with the structure of the conveyor 16 by means of a bracket. As shown in FIG. 12 the cylindrical part of the piston and cylinder unit 20 abuts against the frame 18. As shown in FIG. 5 the conveyor 16, when it is in its lower position, is inclined towards the outlet opening of the machine 10, as represented diagrammatically by a horizontal arrow F, the level of this outlet opening being sufficiently far below that of the pivot axis A of the conveyor 16. At the time of pivoting of the conveyor 16, its free end will move along a circular arc which extends into a recess 14A in the door 14 near a projecting ledge 10A of the machine 10 which constitutes the upper limit of the opening of the machine 10 which is shut by the door 14. The minimum clearance between the ledge 10A and the path of motion of the free ends of the conveyor 16 is for example approximately 5 mm. At its free end the conveyor 16 bears several flexible lugs 22, which prolong the conveying table 24 of the conveyor 16 and are adapted to rest on the lower edge of the outlet opening of the machine 10. When the conveyor 16 is lifted the lugs 22 will touch the ledge 10A and will bend in order not to oppose the movement of the conveyor into its lifted position.

The conveyor 16 is of the belt type, the upper run 26A of the belt 26 extending over the conveying table 24 whereas the lower run 26B is arranged underneath the same. At the articulated end of the conveyor 16 the belt runs around a drive roller 28. The drive roller 28 is connected with a drive shaft 30 (see FIG. 11) whose axis coincides with the pivot axis of the conveyor 16. The transmission shaft 30 is mounted in bearings 32 mounted on the lower surface of the conveying table 24 and in bearings 34 and 36 secured to flanges 18A and 18B of the frame 18.

Figure 6:
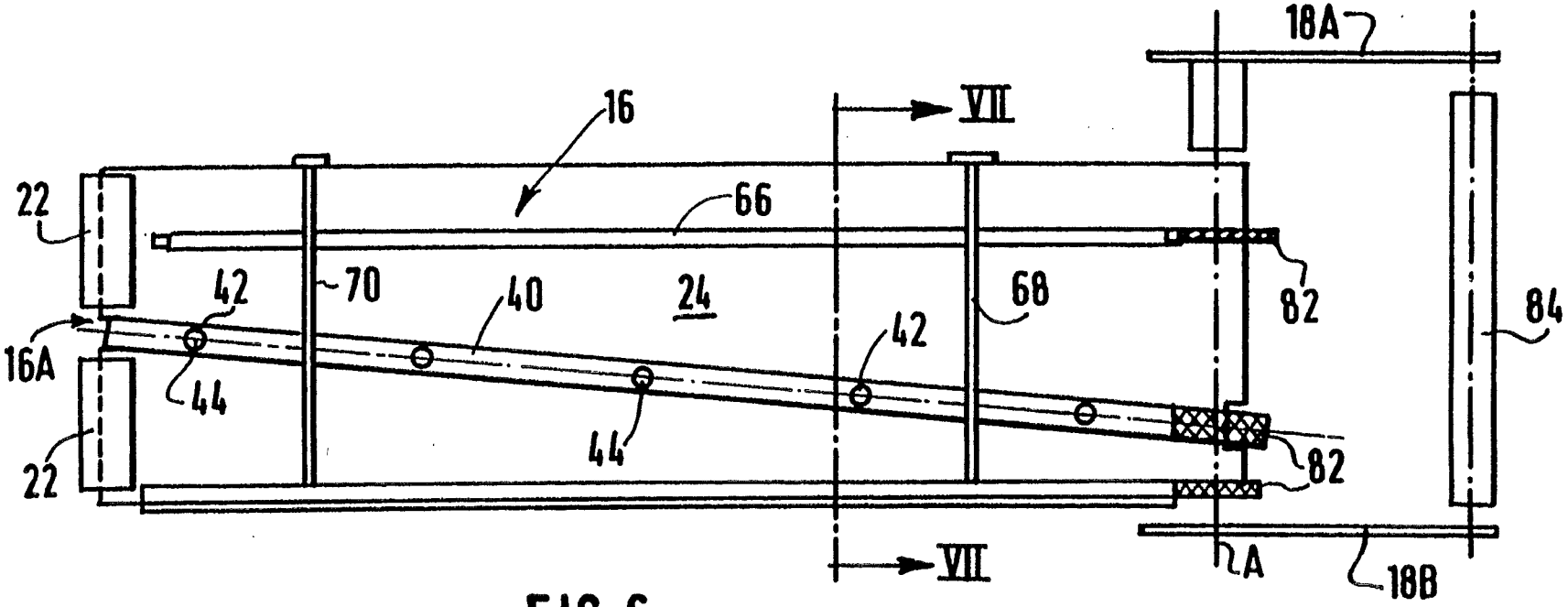
FIG. 6 is a diagrammatic plan view of the conveyor pivotally mounted in a frame integral with the finishing machine.
Figure 7:
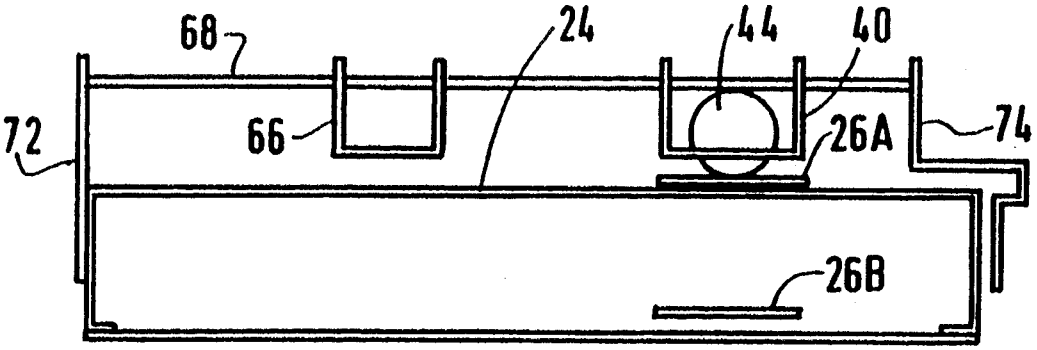
FIG. 7 is a diagrammatic sectional view taken on the line VII—VII of FIG. 6.
Figure 8:
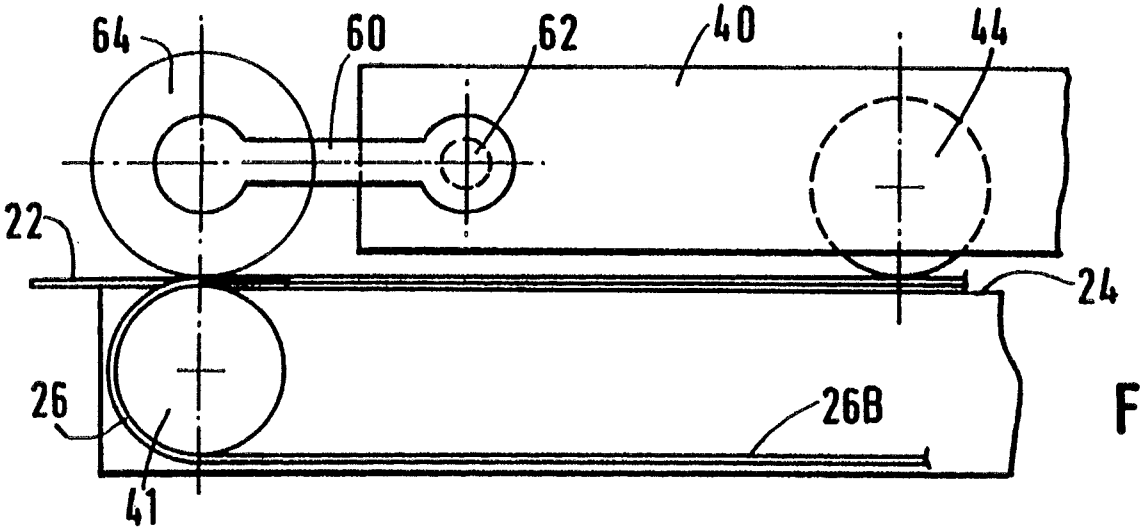
FIG. 8 is a diagrammatic elevation of the free end of the conveyor.

A rail 40 with a U cross section is arranged over the belt 26 at a distance from it and from the conveying table 24. As shown in FIG. 6, such rail 40 and the belt 26 are inclined in relation to the longitudinal direction of the conveying table 24. At the free end 16A of the conveyor 16, the belt 26 is mounted on a bend roller 41 (FIG. 8) positioned substantially in the middle of the free end of the conveying table 24. On the other hand the drive roller 28 is adjacent to the flange 18B of the frame 18, the rail 40 and the belt 26 being at an angle of approximately 5 to the longitudinal direction of the conveying table 24. The rail 40 has a series of recesses 42 spaced out regularly along the length of the conveying table 24. In each of such recesses 42 a ball is arranged so that it may rotate freely. The balls 44 rest under the action of gravity on the upper surface of the belt 26.

Since the belt 26 extends in an inclined manner in relation to longitudinal direction of the conveying table 24, the axes of the drive roller 28 and of the bend roller 41 are inclined by the same amount in relation to the transverse direction of the conveying table 24. The shaft of the drive roller 28 mounted in the bearings 50 secured underneath the conveying table 24 is connected to the drive shaft 30 by means of a coupling spring 52, which allows there to be an angle between the axes of the shaft 30 and the roller 28.

At its end adjacent to the bend roller 41 the rail 40 bears a pair of arms 64 pivoting around a horizontal axis 62 and bearing, for their part, a nip roller 60 urged into contact with the upper run 26A of the belt 26, in alignment with the bend roller 41.

The rail 40, and a second rail 66 with a U-like cross section are borne by two transverse rods 68 and 70 whose ends are secured to the lateral walls 72 and 74 of the conveyor 16. The lateral wall 74 constitutes an aligning abutment for the sets of sheets moved by the conveyor. The rail 66 extends in parallelism to the other lateral wall 74.

The rail constitutes a support for the balls 44 and, simultaneously, a means protecting the belt 26. For its part the rail 66 constitutes a deflection means for the sheets of a set of sheets moved by the belt 26 on the conveying table 24.

Figure 9:
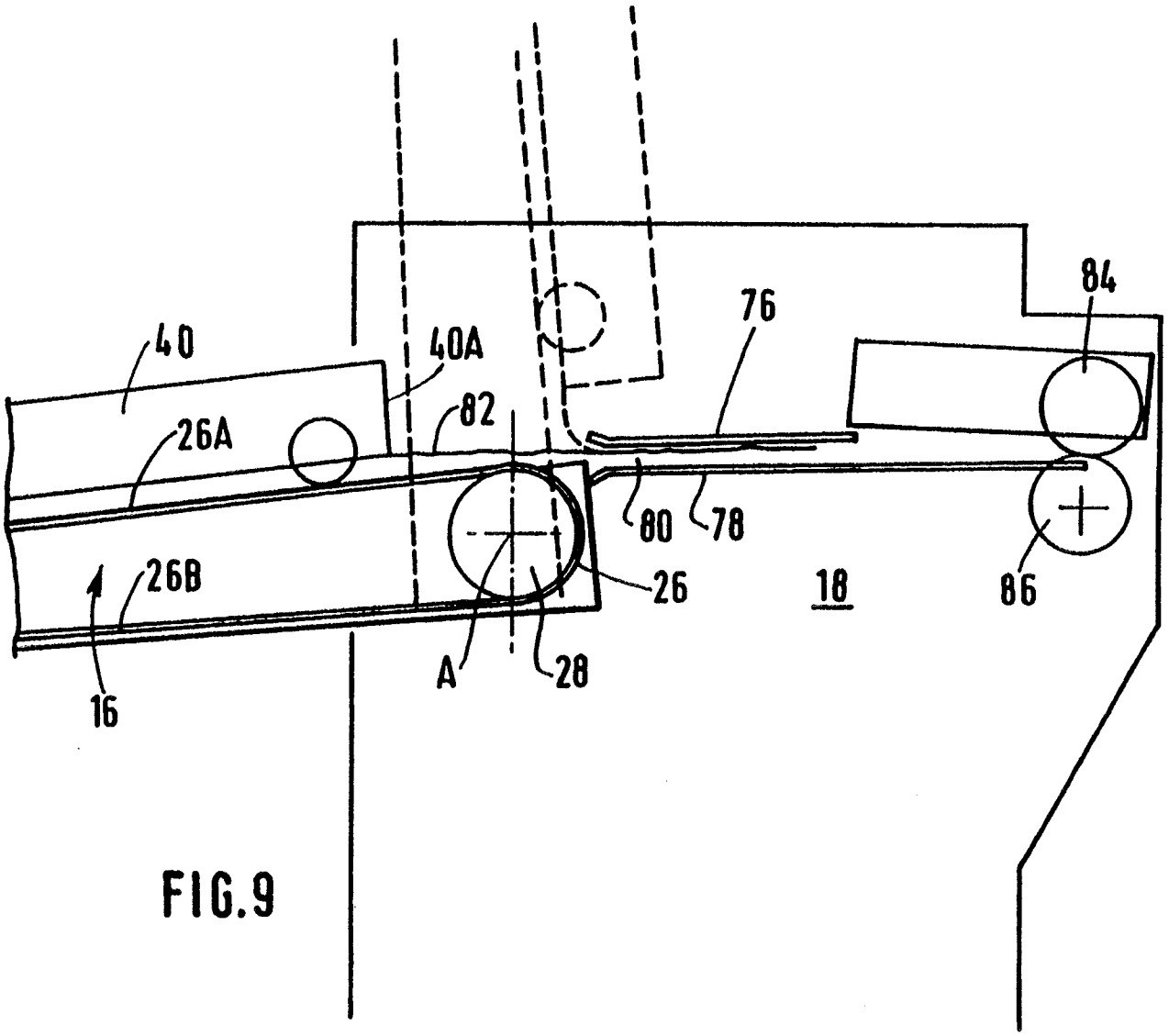
FIG. 9 is a diagrammatic elevation showing the articulation of the conveyor in the frame of the finishing machine.

As shown in FIG. 9, rail 40 comes to an end well short of the vertical plane extending through the pivot axis A of the conveyor 16 in order to create a safety distance between the edge 40A at its free end and the adjacent parts of the device when the conveyor is in its raised position, shown in broken lines in FIG. 9. In this position the edge 40A is at a distance of approximately 25 mm or more from an upper sheet metal guide 76, which together with a lower sheet metal guide 78 delimits a guide gap 80 for the sets of sheet coming off the conveyor 16. The safety distance thus formed between the edge 40A and the sheet metal guide 76 is an important aspect of the device, since it prevents any risk of injury to a person using the machine who may have placed his finger on the front edge of the sheet metal guide 76 or on the end of the rail 40.

In order to ensure continuous guidance of the sets of sheets coming from the conveyor 16 and going into the gap 80, the rails 40, 66 and 74 each bear a flexible extension 82 at their ends adjacent to the drive roller 28. These flexible extension 82 extend toward and into the gap 80 and are trapped therein during pivotal movement of the conveyor 16.

The transfer device furthermore comprises a pair of transfer rollers 84 and 86 arranged downstream from the guide gap and ensuring the transfer of the sets of sheets moved by the conveyor 16 toward the finishing unit of the machine 12.

Figure 10:
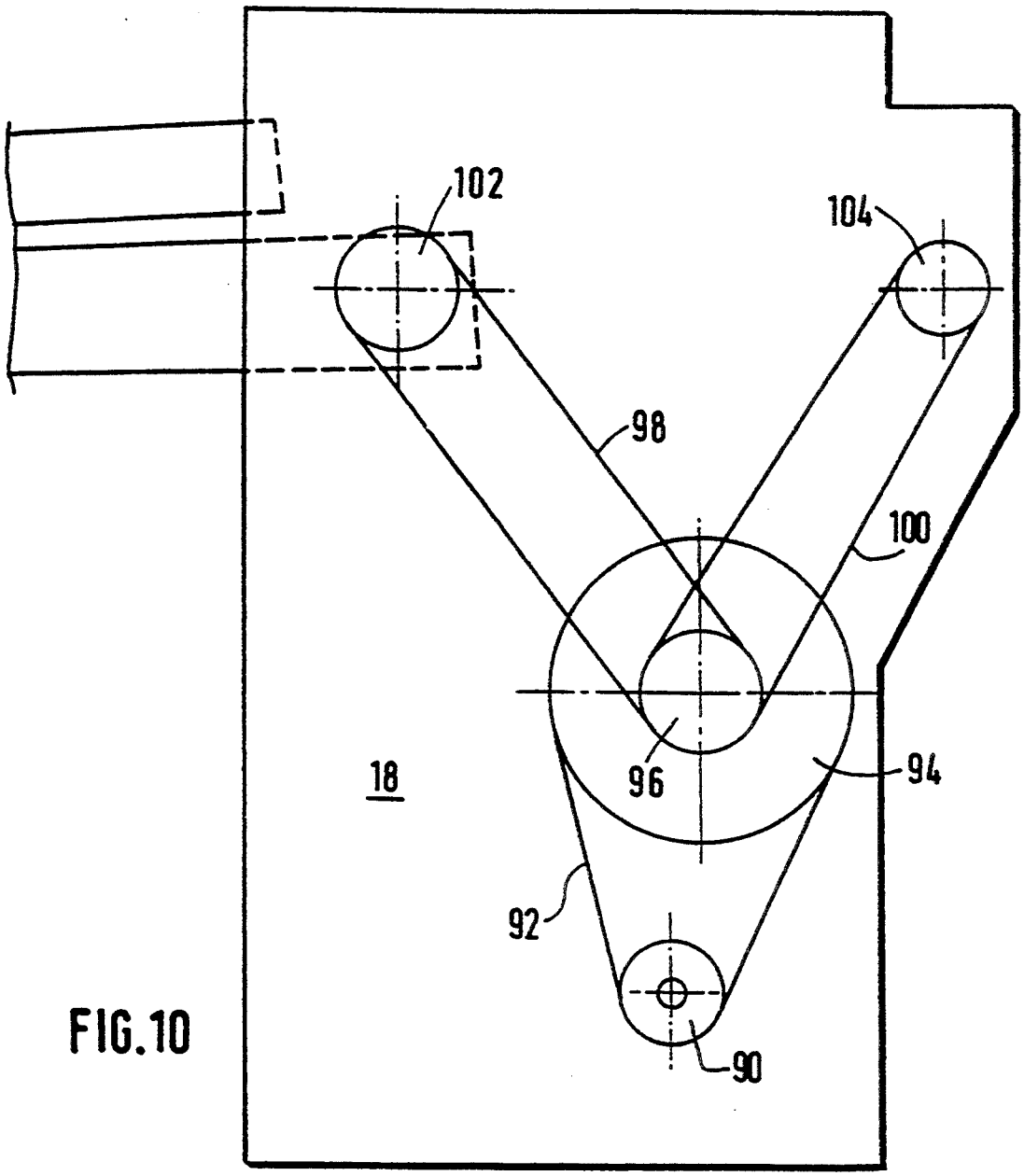
FIG. 10 shows the common drive means for the conveyor and the finishing machine.

An other important detail of the machine will be seen in FIG. 10. The machine is fitted with a common drive for the conveyor 16 and its finishing unit. In FIG. 10 the reader will see a drive pulley 90 on the side of the frame 18. A belt 92 is trained over the pulley 90 and a reduction pulley 94. This reduction pulley 94 is integral with two distribution pulleys 96. By means of belts 98 and 100 the rotation of the pulleys is transmitted to a pulley 102 keyed on the drive shaft 30 and, respectively, a pulley 104 keyed on the drive roller 84. The common drive ensures fully synchronous operation of the conveyor with the operation of the machine 12.

During operation, when the conveyor is in its lower position, the sets of sheets coming off the machine 10 will move as indicated by the arrow F (FIG. 5) and will then be introduced into the gap between the nip roller 64 and the belt 26 in order to loaded on the conveyor 16. By means of the balls 44, the sheets of the set are held against the belt 26. During the movement of a set of sheets on the conveying table 24 the rail 66 will prevent any tendency of the sheets to flutter. Although the belt 26 is completely protected by the rail 40, the conveyor is freely accessible from all sides in order to permit servicing when required. When the sets of sheets come off the conveyor 16 their front edge is introduced into the gap 80 constituted between the sheet metal guides 76 and 78, a continuous guiding action being ensured by the flexible extension 82. Then the set is loaded by the transfer rollers 84 and 86 in order to be transferred toward the finishing unit of the machine 12.

For adjustment of the height of the conveyor 16 in relation to the level of the lower edge of the outlet opening of the machine 10 it is sufficient to reset the height of the casters on which the machine 12 is borne.

When it is necessary to open door 14 of the machine 10, the conveyor 16 is pivoted into the elevated position thereof by a manual operation, assisted by the pneumatic piston and cylinder unit 20. After closing the door 14 all that is required is to return the conveyor 16 into its lower position as defined by the abutment 18.

What is claimed is:

1. A transfer device for transferring sets of sheets coming from a reproducing machine to a finishing machine having a frame and spaced a predetermined distance from said reproducing machine, said reproducing machine having a door with an ejection opening and said finishing machine having an intake side opposite said door, and comprising a sheet set conveyor pivotally mounted about a horizontal pivot axis in said frame on a first longitudinal end and having a second, cantilevered end movable along an arcuate path between a first, lowered position in front of and adjacent to said ejection opening and a second, raised position, said conveyor with said second end in said raised position permitting access to and free opening of said door, said conveyor having a conveyor belt and a drive roller at said first longitudinal end, and said drive roller being connected with a drive shaft which is coaxial with said pivot axis of said conveyor.

2. The device as claimed in claim 1, wherein said piston and cylinder unit is provided to assist pivotal movement of said conveyor.

3. The device as claimed in claim 1, wherein said lowered position of said conveyor is defined by an abutment means arranged on said finishing machine.

4. The device as claimed in claim 3, wherein said lowered position of the conveyor is adjustable by height adjustment of said finishing machine.

5. The device as claimed in claim 4, wherein said conveyor has a deflection roller and a nip roller urged into contact with said deflection roller on said second end.

6. The device as claimed in claim 1, wherein said conveyor has a longitudinal table with a longitudinal sheet alignment abutment, and said belt is inclined in relation to and towards said sheet alignment abutment.

7. The device as claimed in claim 6, wherein a first rail is mounted above said table parallel to said belt and has a series of recesses spaced in a longitudinal direction of said rail, a ball being mounted for free rotation and in contact under the action of gravity on said belt in each of said recesses.

8. The device as claimed in claim 7, wherein a second rail is mounted above said table alongside said first rail and in the same plane.

9. The device as claimed in claim 8, wherein said first and second rails are supported by two transverse rods.

10. The device as claimed in claim 7, wherein an end of said first rail adjacent to said drive roller is spaced from a pivot axis of said conveyor by such an amount that in said raised position of the conveyor there is a safety clearance of at least approximately 25 mm beneath said end of the rail.

11. A transfer device for transferring sets of sheets coming from a reproducing machine to a finishing machine having a frame and spaced a predetermined distance from said reproducing machine, said reproducing machine having a door with an ejection opening and said finishing machine having an intake side opposite said door, and comprising a sheet set conveyor pivotally mounted about a horizontal pivot axis in said frame on a first longitudinal end and having a second, cantilevered end movable along an arcuate path between a first, lowered position in front of and adjacent to said ejection opening and a second, raised position, said conveyor with said second end in said raised position permitting access to and free opening of said door, a guide gap being defined downstream from said conveyer in said finishing machine between a pair of guiding members, and said conveyer carrying at least one flexible elongated extension extending toward and into said guide gap.

12. The device as claimed in claim 11, wherein said conveyer comprises first and second lateral guide rails, each of said guide rails carrying a flexible elongated extension which extends into said guide gap.

13. The device as claimed in claim 11, wherein said conveyor carries at least one flexible lip on said second end which is adapted to bear against a lower edge of said ejection opening and to move clear thereof on contact with a projecting part of said reproducing machine when said second conveyor end passes in front of said projecting part.

14. The device as claimed in claim 11, wherein a pair of transfer rollers are provided downstream of said conveyor and upstream of said finishing machine.

15. The device as claimed in claim 11, wherein a common drive is provided for said conveyor and for said finishing machine.

* * * * *